US012392268B1

(12) United States Patent
Mainiero

(10) Patent No.: US 12,392,268 B1
(45) Date of Patent: Aug. 19, 2025

(54) OIL DRAIN PLUG SYSTEM AND METHOD

(71) Applicant: Joe Mainiero, Lake Worth, FL (US)

(72) Inventor: Joe Mainiero, Lake Worth, FL (US)

( * ) Notice: Subject to any disclaimer, the term of this patent is extended or adjusted under 35 U.S.C. 154(b) by 0 days.

(21) Appl. No.: 18/641,686

(22) Filed: Apr. 22, 2024

(51) Int. Cl.
*F01M 11/04* (2006.01)

(52) U.S. Cl.
CPC . *F01M 11/0408* (2013.01); *F01M 2011/0425* (2013.01)

(58) Field of Classification Search
CPC ..... F01M 2011/0416; F01M 11/0458; F01M 2011/0425; F01M 11/0408; Y10T 137/6881; Y10T 137/6058; Y10T 70/5646; Y10T 137/6092
USPC ..... 251/144, 216, 351, 344, 346, 215, 296, 251/208, 209, 309, 310; 184/1.5, 65, 70, 184/80, 86, 105.3, 36
See application file for complete search history.

(56) References Cited

U.S. PATENT DOCUMENTS 1,678,927 A * 7/1928 Weatherhead, Jr. ..... F16K 1/04 251/351
1,684,932 A * 9/1928 Weatherhead, Jr. ... B21K 25/00 29/523
2,474,430 A * 6/1949 Laue ..... F16K 1/02 251/216
2,800,912 A * 7/1957 McCamish ..... F16K 17/16 285/414
3,869,391 A * 3/1975 Kramer ..... F15B 21/041 210/232
3,948,481 A * 4/1976 Pollock ..... F01P 11/0276 251/351
4,025,048 A * 5/1977 Tibbitts ..... F16K 1/12 222/525
4,193,575 A * 3/1980 Burgess ..... F01P 11/0276 220/375
4,807,847 A * 2/1989 Martz ..... F16K 1/38 251/351
5,144,978 A * 9/1992 Brown ..... B01D 36/001 251/351
5,441,234 A * 8/1995 White ..... B61C 5/00 251/351
6,062,540 A * 5/2000 Hubler ..... F16K 1/04 251/351
6,260,823 B1 * 7/2001 Weber ..... B65D 51/1683 222/481.5
7,121,526 B2 * 10/2006 Alvarez ..... F16K 5/0414 251/215
7,410,146 B2 * 8/2008 Huang ..... F16K 3/265 251/215
8,800,966 B2 * 8/2014 Cordes ..... F01M 11/04 251/344
2011/0100756 A1 * 5/2011 Peng ..... F01M 11/03 184/1.5
2014/0091244 A1 * 4/2014 Gricourt ..... F01M 11/0408 251/148

* cited by examiner

*Primary Examiner* — Craig J Price
(74) *Attorney, Agent, or Firm* — Uradnik Law Firm PA

(57) ABSTRACT

An oil drain plug assembly includes a threaded drive nut rotatable to open and close a valve assembly controlling the flow of oil from an oil reservoir, the valve assembly including a valve body with a threaded hollow valve rod extending therethrough, wherein the distal end of the valve assembly is in fluid communication with the oil reservoir, the threads of the hollow valve rod are positioned on the outer surface of the hollow valve rod away from its distal end, and the threaded drive nut is threaded onto the threads of the hollow valve rod.

3 Claims, 5 Drawing Sheets

OIL DRAIN PLUG SYSTEM AND METHOD

FIELD OF THE DISCLOSURE

The invention relates generally to a vehicle oil drain plug, and more particularly, to a drain plug including a threaded drive nut rotatable to open and close a fluid pathway through a threaded hollow valve rod.

BACKGROUND

Vehicles, such as trucks, automobiles, ATVs, snow machines, lawnmowers, etc., typically include a store of oil for the lubrication of internal engine parts. It is necessary to periodically change the oil in such vehicles. Often, a simple threaded plug in the bottom of an oil pan is used. However, removal of the plug to drain the oil can be difficult and messy. Thus, there remains a need for an improved oil drain plug system and method.

SUMMARY

The present disclosure provides in one specific embodiment an oil drain plug assembly including a threaded drive nut rotatable to open and close a valve assembly controlling the flow of oil from an oil reservoir. The valve assembly includes a valve body with a threaded hollow valve rod extending therethrough. The distal end of the valve assembly is in fluid communication with the oil reservoir. The threads of the hollow valve rod are positioned on the outer surface of the hollow valve rod away from its distal end. The threaded drive nut is threaded onto the threads of the hollow valve rod.

The hollow valve rod includes an inner lumen extending along its length. The hollow valve rod is open at it proximal end and closed at its distal end. However, a plurality of holes through the wall of the hollow valve rod are disposed proximate the hallow valve rod's distal end.

When the oil drain plug assembly is closed, the holes proximate the distal end of the hollow valve rod are fully disposed inside the distal end of the valve body, so that no oil from the oil reservoir may pass through the holes and into the inner lumen of the hollow valve rod.

Opening the oil drain plug assembly is accomplished by rotating the threaded drive nut in a first direction, which causes the hollow valve rod to move distally to move the holes outside the valve body and into fluid communication with the oil reservoir.

When the oil drain plug assembly is open, oil from the reservoir may flow through the holes and into the inner lumen of the hollow valve rod. From there, the oil may pass out of the proximal end of the hollow valve rod and thus drain the oil reservoir. In another embodiment, the proximal end of the threaded drive nut is threaded on its inner or outer surface to receive a plug or cap, respectively. In this other embodiment, draining the oil reservoir may be accomplished by removing the plug or cap and allowing the oil to flow from the inner lumen of the hollow valve rod through the threaded drive nut at its proximal end.

Closing the oil drain plug assembly, then, can be achieved by rotating the drive nut in a second direction opposite the first direction, which causes the hollow valve rod to move proximately so that the holes move into the valve body. In an embodiment with a plug or cap, the plug or cap may be threaded into the proximal end of the threaded drive nut.

Other benefits and advantages of the present disclosure will be appreciated from the following detailed description.

DETAILED DESCRIPTION

Figure 1:
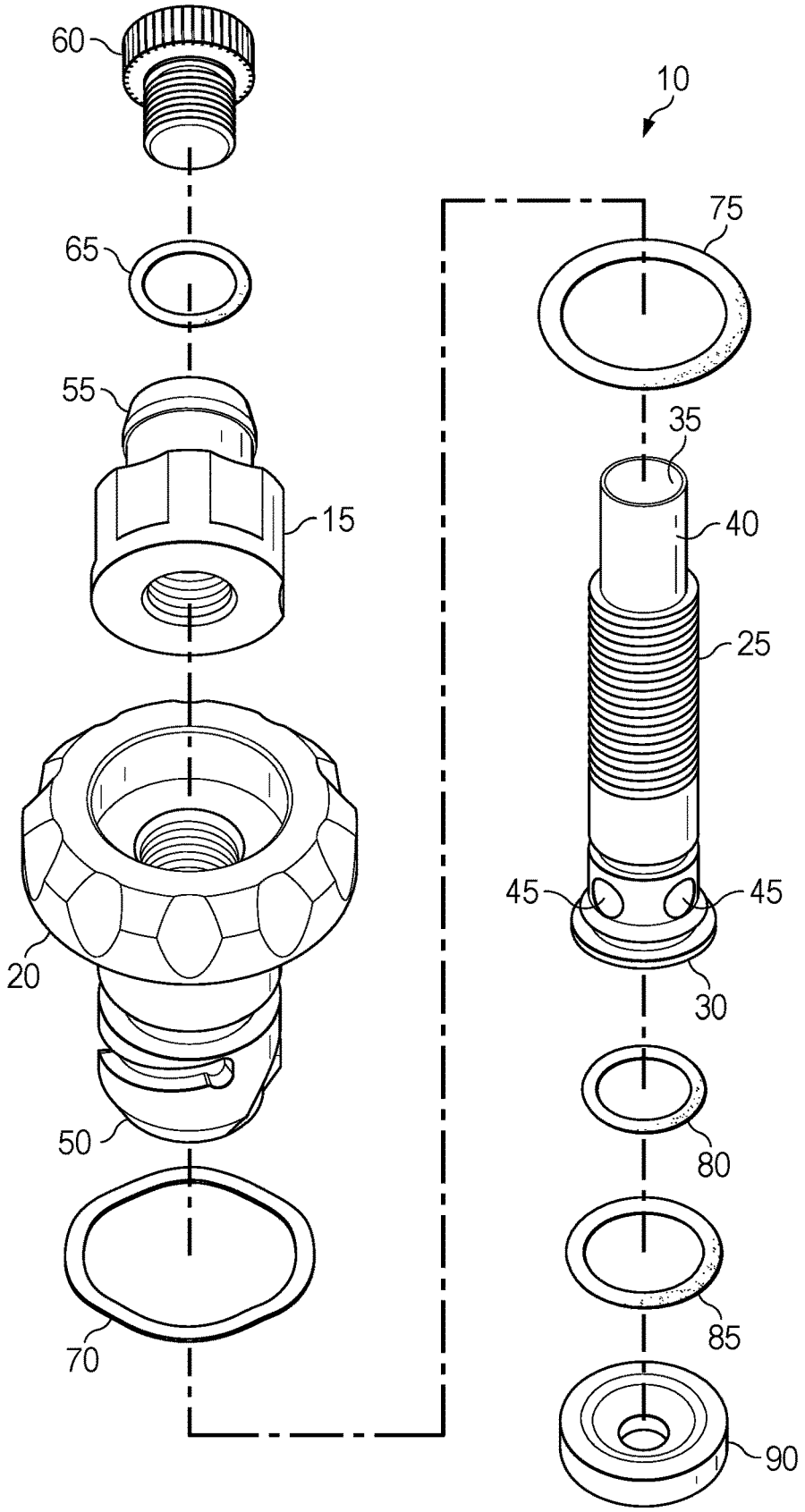
FIG. 1 is an exploded view of an exemplary oil drain plug assembly according to the description provided herein.
Figure 2:
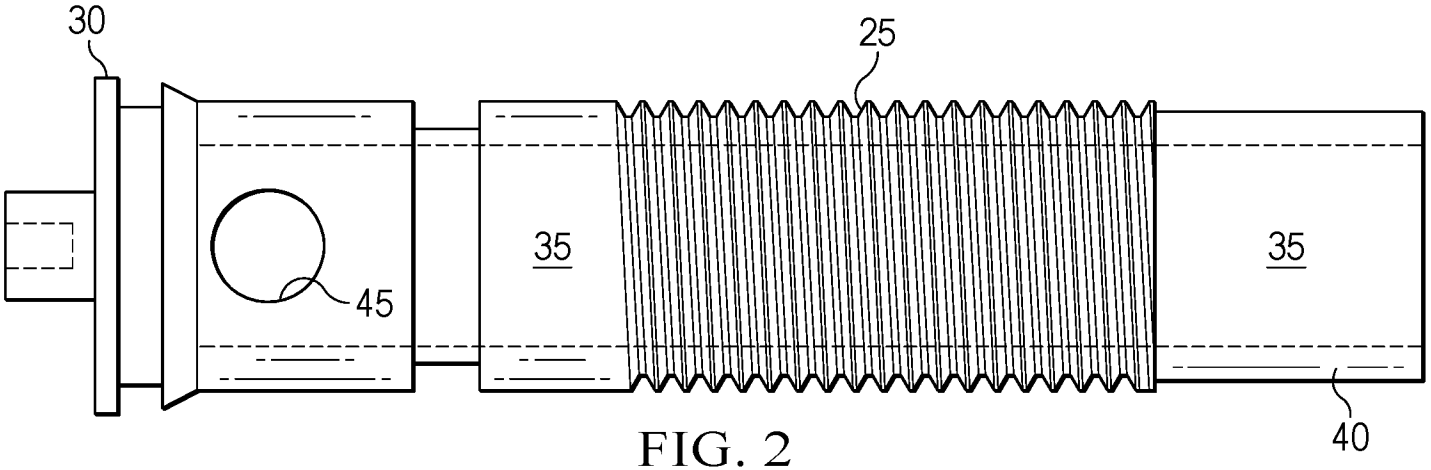
FIG. 2 is a side view of an exemplary hollow valve rod as shown in FIG. 1.

Embodiments of the invention and various alternatives are described. Those skilled in the art will recognize, given the teachings herein, that numerous alternatives and equivalents exist which do not depart from the invention. It is therefore intended that the invention not be limited by the description set forth herein or below.

One or more specific embodiments of the system and method will be described below. These described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Further, for clarity and convenience only, and without limitation, the disclosure (including the drawings) sets forth exemplary representations of only certain aspects of events and/or circumstances related to this disclosure. Those skilled in the art will recognize, given the teachings herein, additional such aspects, events and/or circumstances related to this disclosure, e.g., additional elements of the devices described; events occurring related to draining oil; etc. Such aspects related to this disclosure do not depart from the invention, and it is therefore intended that the invention not be limited by the certain aspects set forth of the events and circumstances related to this disclosure.

The present disclosure in one embodiment provides an oil drain plug assembly 10 including a threaded drive nut 15 rotatable to open and close a valve assembly controlling the flow of oil from an oil reservoir. The valve assembly includes a valve body 20 with a threaded hollow valve rod 25 extending therethrough. The distal end of the valve assembly is in fluid communication with the oil reservoir. The threads of the hollow valve rod 25 are positioned on the outer surface of the hollow valve rod 25 away from its distal end 30. The threaded drive nut 15 is threaded onto the threads of the hollow valve rod 25.

The hollow valve rod 25 includes an inner lumen 35 extending along its length. The hollow valve rod 25 is open at its proximal end 40 and closed at its distal end 30. However, a plurality of holes 45 through the wall of the hollow valve rod 25 are disposed proximate the distal end of the hollow valve rod 25.

When the oil drain plug assembly is closed, the holes 45 proximate the distal end 30 of the hollow valve rod 25 are fully disposed inside the distal end 50 of the valve body 20, so that no oil from the oil reservoir may pass through the holes 45 and into the inner lumen 35 of the hollow valve rod 25.

Opening the oil drain plug assembly is accomplished by rotating the threaded drive nut 15 in a first direction, which causes the hollow valve rod 25 to move distally to move the holes 45 outside the valve body 20 and into fluid communication with the oil reservoir.

When the oil drain plug assembly is open, oil from the reservoir may flow through the holes 45 and into the inner lumen 35 of the hollow valve rod 25. From there, the oil may pass out of the proximal end 40 of the hollow valve rod 25 and thus drain the oil reservoir. In another embodiment, the proximal end 55 of the threaded drive nut 15 is threaded on its inner or outer surface to receive a plug 60 or cap, respectively. In this other embodiment, draining the oil reservoir may be accomplished by removing the plug 60 or cap.

Closing the oil drain plug assembly, then, can be achieved by rotating the drive nut 15 in a second direction opposite the first direction, which causes the hollow valve rod 25 to move proximately so that the holes 45 move into the valve body 20. In an embodiment with a plug 60 or cap, the plug 60 or cap may be threaded into or onto the proximal end 55 of the drive nut 15.

Figure 3A:
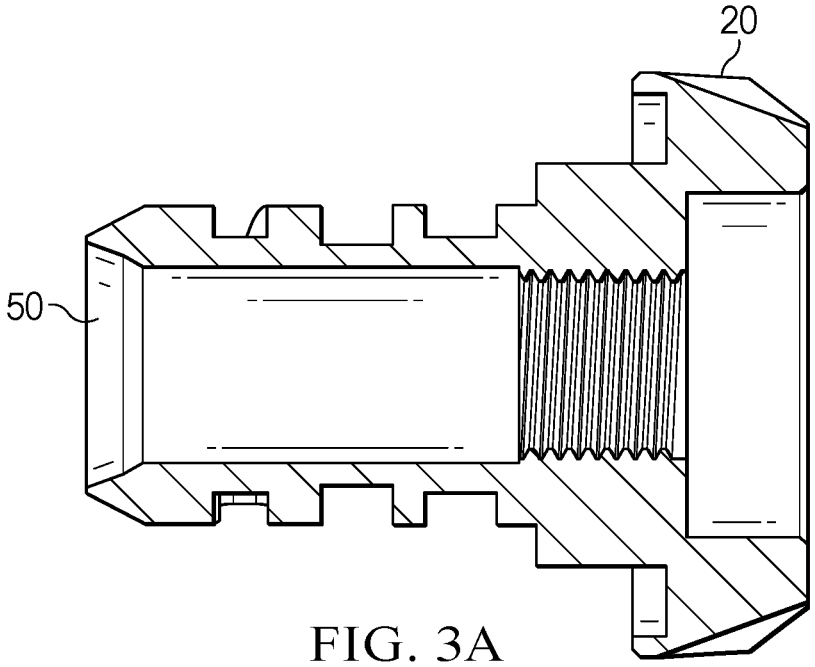
FIG. 3A is a cross-sectional view of an exemplary valve body as shown in FIG. 1, including a push-lock assembly for removably mounting to an oil pan or other oil reservoir holding compartment.
Figure 3B:
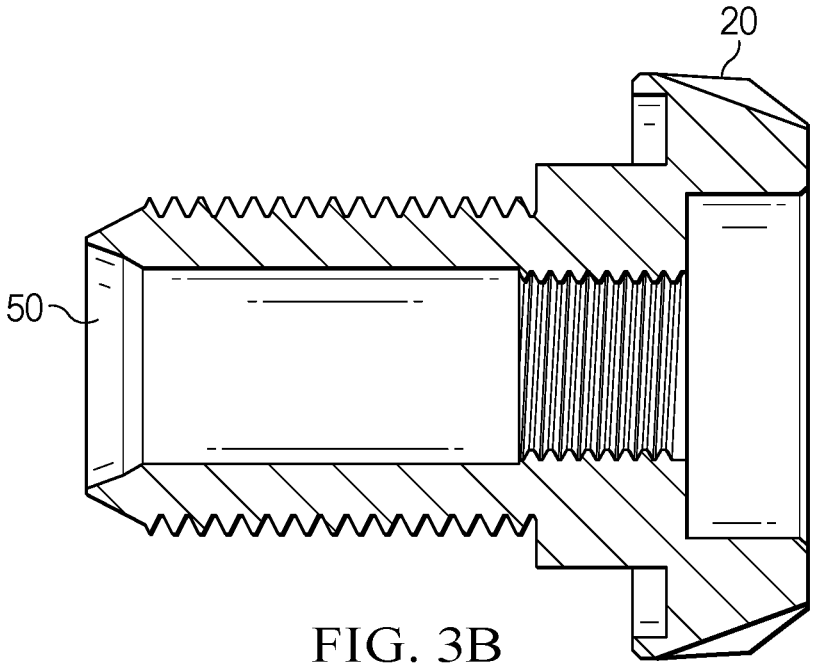
FIG. 3B is a cross-sectional view of an exemplary valve body as shown in FIG. 1, including a thread assembly for removably threadingly mounting to an oil pan or other oil reservoir holding compartment.
Figure 4:
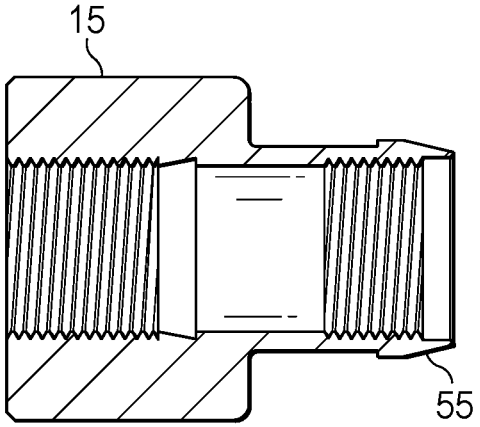
FIG. 4 is a cross-sectional view of an exemplary threaded drive nut as shown in FIG. 1.
Figure 5:
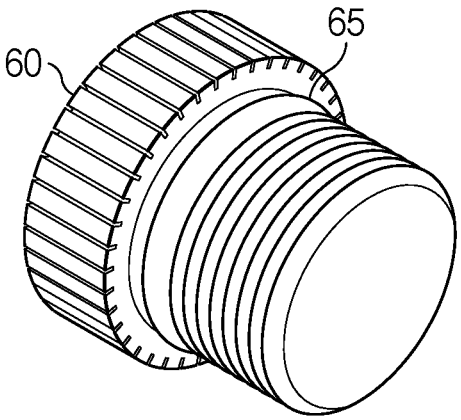
FIG. 5 is a perspective view of an exemplary plug as shown in FIG. 1.
Figure 6:
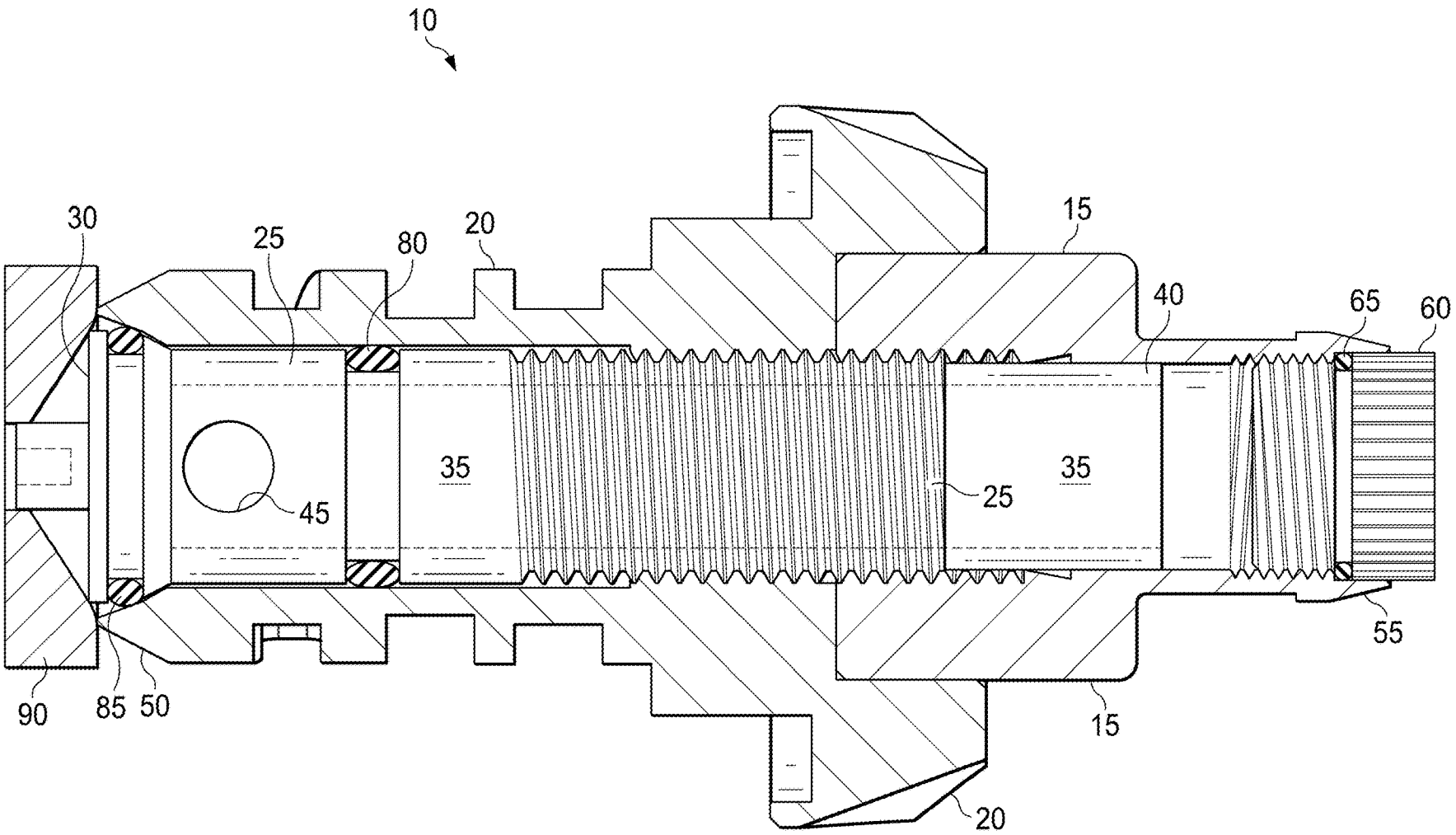
FIG. 6 is a cross-sectional view of the exemplary oil drain plug assembly as shown in FIG. 1.

An o-ring 65 may be positioned between the plug 60 or cap and the drive nut 15 to prevent the unwanted escape of oil. A ring 70 may promote the mounting of the valve body 20 in the bottom of an oil pan or other similar location. The valve body 20 may be adapted with a push-locking arrangement that mates with the oil pan or other device for holding oil. See FIG. 3A. Alternately, the valve body 20 may be threaded on its outside surface proximate distal end 50 for threaded engagement with the oil pan or other device for holding oil. See FIG. 3B. An o-ring 75 may be disposed between the valve body 20 and the oil pan or other device for holding oil.

An o-ring 80 may be disposed between the inner wall of the valve body 20 and the outer wall of hollow valve rod 25 to prevent the unwanted escape of oil. Similarly, an o-ring 85 may be positioned at the distal end 30 of hollow valve rod 25, to form a seal between the distal end 50 of valve body 20 and the distal end 30 of hollow valve rod 25. Finally, a magnet 90 may be positioned at the distal end 30 of hollow valve rod 25 to attract and hold any metal pieces present in the oil reservoir.

It should be understood that the foregoing description is only illustrative of the invention. Various alternatives and modifications can be devised by those skilled in the art having the benefit of this disclosure, without departing from the invention. Accordingly, the invention is intended to embrace all such alternatives, modifications, and variances.

Certain exemplary embodiments of the disclosure may be described. Of course, the embodiments may be modified in form and content, and are not exhaustive, i.e., additional aspects of the disclosure, as well as additional embodiments, will be understood and may be set forth in view of the description herein. Further, while the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents and alternatives falling within the spirit and scope of the invention.

What is claimed is:

1. An oil drain plug assembly including:

a valve body including a valve body proximal end, a valve body distal end, and a valve body lumen extending therethrough between the valve body proximal end and the valve body distal end;

a drive nut disposed within the valve body proximal end, the drive nut including a drive nut lumen extending the length of the drive nut from a drive nut proximal end to a drive nut distal end, a wall of the drive nut lumen proximate the drive nut distal end including threads;

a threaded valve rod including valve rod threads along the length of the threaded valve rod, the valve rod threads on an outer surface of the threaded valve rod and spaced from a threaded valve rod distal end and spaced from a threaded valve rod proximal end; wherein the threaded valve rod includes an threaded valve rod inner lumen extending between the threaded valve rod proximal end to the threaded valve rod distal end; wherein the threaded valve rod inner lumen is open at the threaded valve rod proximal end and is closed at the threaded valve rod distal end; and wherein at least one hole extends from the outer surface of the threaded valve rod to the threaded valve rod lumen proximate the threaded valve rod distal end;

wherein the threaded valve rod extends through the valve body lumen;

wherein the drive nut distal end is threadingly engaged with the valve rod threads;

wherein rotation of the drive nut in a first direction causes the threaded valve rod to move distally within the valve body;

wherein rotation of the drive nut in a second direction opposite the first direction causes the threaded valve rod to move proximally within the valve body; and wherein a continuous fluid lumen extends from the at least one hole through the threaded valve rod inner lumen and through at least a portion of the drive nut lumen.

2. The oil drain plug assembly of claim 1, wherein rotation of the drive nut in the second direction causes the at least one hole to move fully inside the valve body lumen to prevent fluid from passing through the at least one hole.

3. The oil drain plug assembly of claim 2, wherein rotation of the drive nut in the first direction causes the at least one hole to move fully outside the valve body lumen to permit fluid to pass through the at least one hole.

* * * * *